US012486065B2

(12) United States Patent
Rolf et al.

(10) Patent No.: US 12,486,065 B2
(45) Date of Patent: Dec. 2, 2025

(54) DEVICE AND METHOD FOR PACKAGING BULK MATERIALS IN OPEN BAGS

(71) Applicant: HAVER & BOECKER OHG, Oelde (DE)

(72) Inventors: Christian Rolf, Oelde (DE); Dominik Bless, Oelde (DE); Heinz-Peter Felling, Beckum (DE); Christian Hinse, Lippetal (DE)

(73) Assignee: HAVER & BOECKER OHG, Oelde (DE)

( * ) Notice: Subject to any disclaimer, the term of this patent is extended or adjusted under 35 U.S.C. 154(b) by 81 days.

(21) Appl. No.: 17/051,875

(22) PCT Filed: May 2, 2019

(86) PCT No.: PCT/EP2019/061292
§ 371 (c)(1),
(2) Date: Oct. 30, 2020

(87) PCT Pub. No.: WO2019/211398
PCT Pub. Date: Nov. 7, 2019

(65) Prior Publication Data

US 2021/0188469 A1 Jun. 24, 2021

(30) Foreign Application Priority Data

May 3, 2018 (DE) ..... 102018110637.8

(51) Int. Cl.
*B65B 1/06* (2006.01)
*B65B 1/02* (2006.01)
(Continued)

(52) U.S. Cl.
CPC ..... *B65B 43/465* (2013.01); *B65B 1/04* (2013.01); *B65B 39/06* (2013.01); *B65B 39/14* (2013.01); *B65B 41/10* (2013.01); *B65B 43/04* (2013.01)

(58) Field of Classification Search
CPC ..... B65B 1/04; B65B 39/06; B65B 39/14; B65B 41/10; B65B 43/04; B65B 43/465
(Continued)

(56) References Cited

U.S. PATENT DOCUMENTS 2,671,585 A * 3/1954 Kindseth ..... B65B 51/07 248/101
3,213,588 A * 10/1965 Peterson ..... B65B 43/262 141/10
(Continued)

FOREIGN PATENT DOCUMENTS

CN 105059616 A 11/2015
DE 19933486 A1 11/2000
(Continued)

OTHER PUBLICATIONS

Search Report received in Chinese Application No. 2019800440549, dated Jan. 26, 2022.
(Continued)

*Primary Examiner* — Thanh K Truong
*Assistant Examiner* — David G Shutty
(74) *Attorney, Agent, or Firm* — Greer, Burns & Crain, Ltd

(57) ABSTRACT

Apparatus and method for filling bulk materials into open-mouth bags, including the following steps:

a) an open-mouth bag is appended from beneath to a filling spout of a filling station by way of an at least partially upwardly motion, so that the bottom end of the open-mouth bag is freely suspended;

(Continued)

b) the filling process is started and bulk material is introduced into the open-mouth bag so that the freely suspended bottom end of the open-mouth bag unfolds; and c) the filling spout is lowered, so that the unfolded bottom end of the open-mouth bag is supported.

10 Claims, 3 Drawing Sheets

(51) Int. Cl.

| | |
|---|---|
| ***B65B 1/04*** | (2006.01) |
| ***B65B 39/06*** | (2006.01) |
| ***B65B 39/10*** | (2006.01) |
| ***B65B 39/14*** | (2006.01) |
| ***B65B 41/10*** | (2006.01) |
| ***B65B 43/04*** | (2006.01) |
| ***B65B 43/46*** | (2006.01) |
| ***B65B 51/14*** | (2006.01) |
| ***B65B 51/32*** | (2006.01) |

(58) Field of Classification Search
USPC ..... 53/459
See application file for complete search history.

(56) References Cited

U.S. PATENT DOCUMENTS 4,162,602 A * 7/1979 Achelpohl ..... B65B 55/24 53/469
4,249,361 A * 2/1981 Tetenborg ..... B65B 51/062 53/469
4,305,242 A * 12/1981 Barathe ..... B65B 31/044 53/512
4,322,932 A * 4/1982 McGregor ..... B65B 39/08 53/284.7
4,510,736 A * 4/1985 Muller ..... B65B 1/02 53/284.7
4,873,815 A * 10/1989 Tetenborg ..... B65B 1/22 53/284.7
4,944,334 A * 7/1990 McGregor ..... B65G 65/463 141/73
5,113,917 A * 5/1992 McGregor ..... B65B 37/00 222/196
5,448,879 A * 9/1995 Concetti ..... B65B 1/02 53/284.7
5,581,982 A * 12/1996 Schroeder ..... B65B 5/067 53/469
5,771,667 A * 6/1998 McGregor ..... B65B 51/146 53/481
6,295,790 B1 * 10/2001 McGregor ..... B65B 1/28 53/374.3
6,401,439 B1 * 6/2002 Tetenborg ..... B65B 43/465 53/567
6,474,050 B1 * 11/2002 Tetenborg ..... B65B 1/22 53/567
6,955,195 B1 * 10/2005 Marceau ..... B65B 39/12 141/10
7,877,966 B2 * 2/2011 Knoke ..... B65B 1/36 53/469
9,150,315 B2 * 10/2015 Vollenkemper ..... B65B 43/30
9,352,860 B2 5/2016 Vollenkemper et al.
9,650,161 B2 5/2017 Wehling
2002/0083684 A1 * 7/2002 Schlosser ..... B65B 39/14 53/459
2011/0136639 A1 * 6/2011 Hilling ..... B65B 1/02 493/87
2015/0284123 A1 * 10/2015 Concetti ..... B65B 1/02 53/459
2016/0001909 A1 * 1/2016 Schütte ..... B65B 51/146 53/134.1
2020/0062429 A1 * 2/2020 Felling ..... B65B 1/06
2021/0188469 A1 * 6/2021 Rolf ..... B65B 1/04

FOREIGN PATENT DOCUMENTS

DE 102007015251 A1 10/2008
DE 102008020254 A1 10/2009

OTHER PUBLICATIONS

International Search Report and Written Opinion for International Patent Application No. PCT/EP2019/061292 mailed Jul. 12, 2019.
German Search Report for DE 10 2018 110 637.8 dated Feb. 20, 2019.

* cited by examiner

DEVICE AND METHOD FOR PACKAGING BULK MATERIALS IN OPEN BAGS

BACKGROUND

The present invention relates to an apparatus and a method for filling bulk materials into open-mouth bags. Such an apparatus may for example be configured as a form-fill-seal system (FFS). An FFS system manufactures the open-mouth bags provided for filling for example from tubular film on site, directly on the machine. Alternately it is possible to feed prefabricated open-mouth bags to the apparatus. The apparatus and the method are in particular employed for bagging bulk materials where a certain air content also enters the open-mouth bag which is then at least partially evacuated out of the open-mouth bag during or after filling.

A great variety of apparatuses and methods have been disclosed for filling bulk materials into open-mouth bags. DE 199 33 486 C2 discloses an apparatus for filling and closing bags open on one side and preferably gusseted. A filling station with a filling spout for filling the bags and a vibrator acting on the bottom of the open-mouth bag are provided. A variety of grippers serve to feed the empty open-mouth bags, to hold the open-mouth bags in the filling station and to discharge the filled open-mouth bags. A conveyor belt begins beneath the filling station for supporting and transporting the filled open-mouth bags. The conveyor belt shows a belt section circulating around two deflection rollers and across two buckle rollers. Beneath the filling station a part of the conveyor belt can be lowered and elevated again by way of pivoting a deflection roller. In the pivoting or drop-down conveyor belt section and immediately beneath the filling station, between the carrying and return sides of the conveyor belt, a bottom vibrator is installed which when tipped up acts on the carrying side of the conveyor belt and thus on a bag bottom resting thereon. The known apparatus provides for an open-mouth bag to be appended on the filling spout. The length of the open-mouth bag is dimensioned such that the bottom end of the open-mouth bag would come to rest on the pivoted-up portion of the conveyor belt. As the filling process begins, the drop-down portion of the conveyor belt is pivoted downwardly so that the bottom end of the open-mouth bag is freely suspended. Already during the filling process the dropped-down portion of the conveyor belt is pivoted upwardly so that the carrying side comes into contact with the bottom end of the open-mouth bag provided for filling. The vibrator installed immediately beneath the carrying side thus acts through the carrying side immediately on the bottom end of the open-mouth bag provided for filling. This achieves an efficient compaction of the bulk material in the open-mouth bag already during the filling process.

Another known apparatus provides for the conveyor belt to begin, not beneath the filling spout but downstream of the filling spout. Beneath the filling spout a bottom vibrator is provided which is generally configured for elevating and lowering. Thus, this known apparatus allows to lower the bottom vibrator prior to beginning filling. Then the bottom end of the open-mouth bag provided for filling is also freely suspended above the bottom vibrator as filling begins. This causes the product thrust first entering the open-mouth bag to unfold the bottom end of the open-mouth bag completely and as a rule wrinkle-free. Thereafter the bottom vibrator can be elevated until the bottom vibrator supports the bottom end of the open-mouth bag provided for filling and acts upon it by vibrating so as to provide effective compaction during a substantial part of the filling process. After completion of the filling process this known apparatus pulls the filled open-mouth bag by means of thrust flaps onto the conveyor belt. During movement, grippers guide the open-mouth bag onto the conveyor belt by the open top of the open-mouth bag. This prior art again functions satisfactorily. A drawback is the high complexity since for one, the bottom vibrator is elevated and lowered by way of a separate drive and furthermore, thrust flaps are employed for pulling the filled open-mouth bag from the bottom vibrator onto the conveyor belt. This is why the entire drive employed must show considerable power.

It is therefore the object of the present invention to provide an apparatus and a method which allow efficiency of filling bulk materials into open-mouth bags involving little complexity.

SUMMARY

The method according to the invention serves for filling bulk materials into open-mouth bags and comprises the following steps in this or an otherwise suitable sequence:

a) an open-mouth bag is appended from beneath to a filling spout of a filling station by way of an at least partially upwardly motion, so that the bottom end of the open-mouth bag is freely suspended;

b) the filling process is started and bulk material is introduced into the open-mouth bag so that the freely suspended bottom end of the open-mouth bag unfolds;

c) the filling spout is lowered, so that the unfolded bottom end of the open-mouth bag is supported.

In particular in a method step c) the filling spout with the appended open-mouth bag is placed on a support and in particular lowered onto a conveyor device (as a support). Preferably the bottom end of the open-mouth bag is supported from beneath in particular by the support or the conveyor device during at least a (considerable) part of the filling process. The bottom end of the open-mouth bag is in particular supported while product is still entering the open-mouth bag.

The method according to the invention has many advantages. A considerable advantage of the method according to the invention consists in that firstly, an open-mouth bag is appended to the filling spout so that the bottom end of the open-mouth bag is freely suspended. This allows to start the filling process and to introduce bulk material into the open-mouth bag while the bottom end of the open-mouth bag is freely suspended and thus can unfold wrinkle-free. Unlike in the prior art, no separate drive for a height-adjustable bottom vibrator is required.

Moreover a conveyor device can be positioned beneath the filling station for discharging the filled open-mouth bag after filling is completed.

It is preferred for the open-mouth bag to be brought near from beneath by way of a pivoting motion so that the filling spout dips into the open-mouth bag in method step a). It is likewise preferred for the filling spout to then open up the open-mouth bag completely in method step a). Prior to or in the method step a) it is preferred for a set of feed grippers to grasp the open-mouth bag at the open-mouth bag front end and to convey it to the filling spout.

The term "open-mouth bag" in the sense of the present invention is understood to mean a specific type of bag, not the state of the bag. Thus, a (still open) open-mouth bag is as a rule closed by a top seam after filling. A closed open-mouth bag continues to be an open-mouth bag, unlike for example a valve bag which comprises a valve that is as a rule sewn in or glued in and automatically closes the valve bag after filling so as to provide a certain protection against escape of material out of the valve bag. In contrast thereto, open-mouth bags are filled through the open-top head end. As a rule this provides a large filling cross section which may optionally be limited by gussets and corner welds therein.

The invention is in particular provided to be used in high and maximum performance ranges where more than 1800 bags per hour and in particular more than 2400 bags per hour and particularly preferably more than 2500 or 2600 or 2700 bags or more per hour are (produced and) filled. Given these speeds, filling in the bulk material takes only about 0.4 to about 0.8 seconds since the remaining indexing time is required for appending the empty open-mouth bag and discharging the filled open-mouth bag. In these indexing time speeds, high accelerating forces in conveying the filled open-mouth bags must be withstood. A driven conveyor device beneath the filling spout on which the filled open-mouth bag rests with its bag bottom allows considerably improved ease of acceleration compared to using thrust flaps which pull a filled open-mouth bag off a bottom vibrator. A "bag" in the sense of the present application is always understood to mean an "open-mouth bag".

In preferred configurations the method step c) provides for the filling spout with the appended open-mouth bag to be lowered onto a support and in particular a conveyor device, where the bottom end of the open-mouth bag is supported from beneath at least during part of the filling process. This means that the open-mouth bag is lowered even during the filling process and while bulk material is being filled into the open-mouth bag. It is possible to start the lowering process prior to starting the bulk material flow. What is essential in the sense of the present invention is that the bulk material arrives at the bottom end of the open-mouth bag before the bottom end of the open-mouth bag is supported on a support and in particular on the conveyor device. Whether to first start the filling process or first the lowering process is a question of controlling and coordinating the processes. What is important is that the bottom end of the open-mouth bag can freely unfold due to the thrust of bulk material. This is ensured if the bottom end is freely suspended as it hits the support.

Preferably the bulk material in the open-mouth bag resting on the conveyor device is in particular compacted at least from beneath during the filling process. To this end at least one compacting device may be integrated or accommodated in the conveyor device and act for example from beneath by vibrating on the standing surface of the conveyor device already during the filling process to compact the bulk material in the open-mouth bag.

In preferred configurations the method step a) provides for holding grippers to grasp the open-mouth bag. The holding grippers are lowered jointly with the filling spout, preferably in the method step c). The holding grippers in particular cause the head end of the open-mouth bag and the gusset region to maintain their defined shape to be followed by controlled transfer of the filled open-mouth bag. This is significant in terms of using the smallest amount of bag material possible. Using as little as 1% more bag material leads to a quite considerable cost increase over a year in the case of continuous operation 24 hours a day. Controlled handling of the open-mouth bags allows economical operation. Unnecessary and uncontrolled repeated grasping is avoided which would result in increased consumption of bag material. Moreover the holding grippers hold the open-mouth bag also during filling.

In preferred specific embodiments the holding grippers release the open-mouth bag after filling is completed and travel upwardly together with the filling spout while the open-mouth bag comes to rest on the conveyor device. Particularly preferably, discharge grippers grasp the head end of the open-mouth bag before the holding grippers release the open-mouth bag to ensure controlled conditions at all times.

In all the configurations it is particularly preferred for the conveyor device to transport the open-mouth bag further after filling is completed. The drive for such transport can be readily realized.

Preferably, discharge grippers guide the open-mouth bag by its head end during transfer.

In all the configurations it is preferred for the open-mouth bag to be formed of tubular film prior to appending. Is is preferred to unwind the tubular film from a film roll. Preferably, a bottom seam is first made in the tubular film and the tubular film is then conveyed further by one index length and in particular one bag length. Thereafter the tubular film is preferably cut off at the head end to form an open-mouth bag. After making the bottom seam, a separate bottom seam cooling may be provided to allow high speeds.

It is preferred to pre-open or open the head end of the open-mouth bag prior to appending to the filling spout. This may for example be provided by way of lateral suckers for controlled pre-opening of the open-mouth bag at its head end.

In an opening station (pre-opening station) that is preferably located upstream of the filling station the open-mouth bag is preferably opened (pre-opened) to allow the filling spout ease of entry. In particular during handover (transporting) of the open-mouth bag from the opening station (pre-opening station), spreaders (showing a profile preferably corresponding to the filling spout) provide controlled spreading of the open-mouth bags. If the open-mouth bag is only pre-opened, complete opening is preferably provided at the filling spout or by means of the filling spout.

In all the configurations it is preferred for the filling spout to be configured as a flap spout and to enter an at least pre-opened head end, and for the flap spout to then tip open, opening the head end wider. Alternately the filling spout may be configured as a stationary filling spout (not tipping up) and may e.g. be a hexagonal spout.

An apparatus according to the invention serves for filling (and preferably also for manufacturing and closing) preferably gusseted open-mouth bags. The apparatus according to the invention is in particular provided for carrying out the method or one of the methods described above. The apparatus according to the invention comprises a control device and a filling station comprising a filling spout for filling the open-mouth bags with bulk materials. A plurality of grippers is provided, the (plurality of) grippers including feed grippers for holding the empty open-mouth bags during feeding to the filling station, holding grippers for holding the open-mouth bags in the filling station, and discharge grippers for holding the filled open-mouth bags during discharge from the filling station. Further grippers may be provided. The apparatus according to the invention further comprises a conveyor device extending up to beneath the filling station for supporting the open-mouth bags and for transporting and in particular discharging the filled open-mouth bags. The filling station accommodates the filling spout together with the holding grippers in a height-adjustable supporting structure. The filling station is suitable for lowering and elevating the supporting structure with the filling spout and the holding grippers, and in particular for taking over the open-mouth bag with the holding grippers. The filling station is furthermore suitable for lowering, during the filling process, the supporting structure with an appended open-mouth bag, for the bottom end of the open-mouth bag to be freely suspended above the conveyor device as filling begins, and thereafter to be put down on a support.

The filling station is in particular suitable for lowering the supporting structure with the appended open-mouth bag (in particular after filling has begun) onto the conveyor device.

The apparatus according to the invention has many advantages. A considerable advantage of the apparatus according to the invention consists in that an open-mouth bag intended for filling is first appended to a filling spout and that as filling begins, the filling spout travels downwardly. As filling begins, a product thrust of the bulk material intended for filling unfolds the bottom end of the open-mouth bag. Thereafter the open-mouth bag can be lowered even during filling so that the bottom end of the open-mouth bag rests, and is in particular supported, on the conveyor device.

Preferably the filling station is suitable for lowering the supporting structure with the appended open-mouth bag after filling begins (toward and onto the conveyor device).

Preferably the filling station is suitable for elevating the supporting structure after discharge of a filled open-mouth bag and prior to appending another open-mouth bag intended for filling. An open-mouth bag intended for filling is appended in an at least partially elevated position. Appending may be done while the filling spout is moving downwardly.

Particularly preferably the filling station is suitable for lowering the supporting structure with the appended open-mouth bag after filling begins so that the bottom end of the open-mouth bag rests on the conveyor device at least during part of the filling process.

In preferred configurations the control device and the filling station are configured and set up

- to elevate the supporting structure with the filling spout and the holding grippers so as to take over the open-mouth bag with the holding grippers preferably in the elevated position, for the bottom end of the open-mouth bag to be freely suspended above the conveyor device as filling begins;
- to keep the supporting structure with an appended open-mouth bag elevated so that the bottom end of the open-mouth bag is freely suspended above the conveyor device (as the filling process begins);
- to lower the supporting structure with an appended open-mouth bag so that the bottom end of the open-mouth bag rests on the conveyor device at least during part of the filling process.

Preferably the conveyor device has a belt section travelling round (at least two) deflection rollers. This belt section is in particular configured as a conveyor belt. A belt section may also be configured as a conveyor chain, plate conveyor or conveyor belt or the like.

Particularly preferably at least one compacting device is comprised. Preferably the compacting device is disposed on the conveyor device or received therein. Preferably the compacting device is disposed beneath a bearing surface of the conveyor device. The compacting device is in particular configured to act on (part of) the bearing surface of the conveyor device (and thus on a bag bottom of an open-mouth bag resting thereon). The compacting device acts in particular immediately on the belt section of the conveyor device. Alternately it is possible for the compacting device to act indirectly on the belt section and thus on the bearing surface of the conveyor device, or alternately through the belt section immediately on the bag bottom. This can be realized e.g. in line-type or strip-type conveyors such as belts or e.g. chains. Then the compacting device preferably acts in the free gaps between the conveyor means in particular immediately on the bottom end. In this case, engaging dogs may be disposed on the conveyor means at specified distances.

The filling station preferably comprises a drive for elevating and lowering the supporting structure. The drive serves to elevate and lower the filling spout and the holding grippers.

In all the configurations it is preferred for the feed grippers and the discharge grippers (and preferably further grippers) to be attached to a support frame of a conveying device. The conveying device may be configured as a linear transport. Preferably the conveying device comprises swing arms and a pendulum drive. This enables the support frame to pivot forwardly and rearwardly by one stroke length (pendulum lift). In the case of symmetric pivoting the support frame is always at the same height both in the forwardly pivoted and the rearwardly pivoted position so as to provide a simple linear transport where a plurality of series-connected processing stations may be provided at distances of one pendulum lift each.

Preferably the open-mouth bag can be appended to the filling spout by way of a pendulum motion of a pendulum unit. The pendulum motion causes the open-mouth bag to pivot upwardly from a lower position towards the filling spout. The motion includes horizontal and vertical components. The pendulum unit may be attached to the support frame of the conveying device, but it may in particular be attached separately therefrom. The pre-opening station respectively bag pre-opening station is in particular assigned to the pendulum unit for appending the open-mouth bag. Preferably the bag pre-opening station pivots along during the pendulum motion.

A processing station may be configured as a bag forming station and another processing station, as a bag pre-opening station or bag opening station. As a rule a filling station is provided. The filling station may be followed by a top seam station and optionally a cooling station for the top seam. Finally the filled open-mouth bag is discharged. In preferred configurations the filling spout is configured as a flap spout and is in particular suitable for entering a (pre-opened) open-mouth bag.

In all the configurations it is preferred for the conveyor device to be height-adjustable to be matched to different bag dimensions. Height adjustment of the conveyor device is not required for each single open bag intended for filling. Also it is not possible to slow down and again accelerate the conveyor device for each open-mouth bag, given indexes of 2000 open-mouth bags and more.

In preferred configurations a roll accommodation for receiving at least one tubular film roll is comprised. In particular is a bag forming station provided for forming open-mouth bags of tubular film.

Preferably a bottom seam station for manufacturing a bottom seam and/or a top seam station for closing the open-mouth bag is comprised. At least one cooling station for cooling a closing seam may be comprised. A closing seam may be a bottom seam or a top seam and in particular a weld seam. Then, welding jaws are preferably provided.

BRIEF DESCRIPTION OF THE DRAWINGS

Further advantages and features of the present invention result from the exemplary embodiments, which are explained hereafter with reference to the appended drawings.

The figures show in.

DETAILED DESCRIPTION

Figure 1:
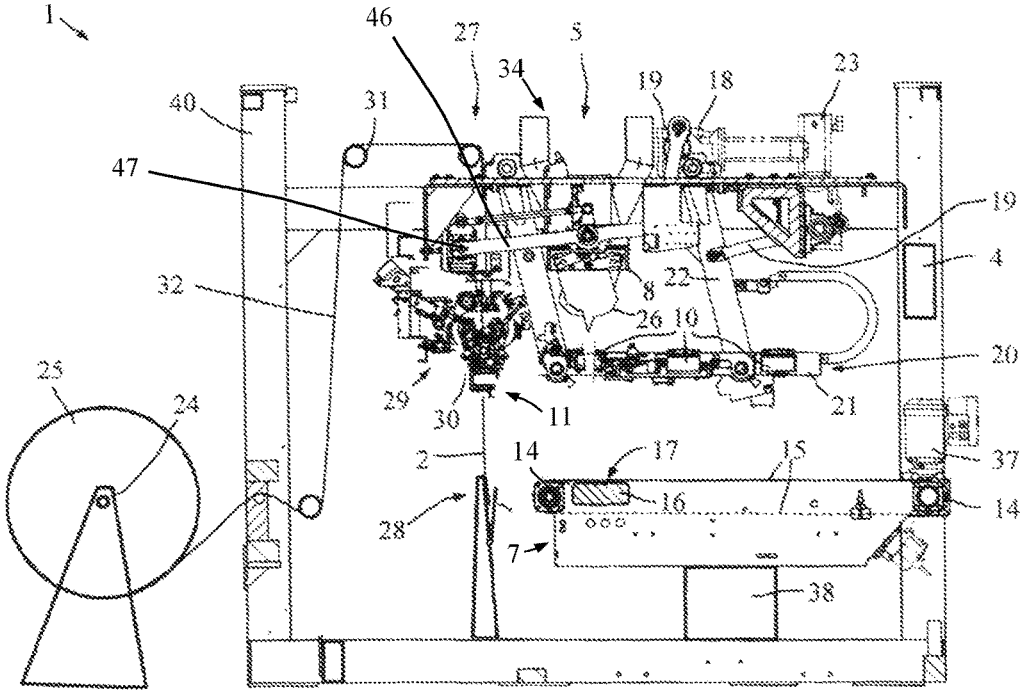
FIG. 1 the apparatus according to the invention in a schematic side cross section in a first position while forming an open-mouth bag.

FIGS. 1 to 4 each show the same apparatus in a schematic side cross section in various positions or states. In all the figures, components and parts of the real apparatus have been omitted to simplify viewing. Although the FIGS. 1, 2, 3, 6 and 7 show the same apparatus, not all the figures illustrate all the components and not all the figures show all the reference numerals.

The apparatus 1 illustrated in the FIGS. 1, 2, 3 and 6 serves for filling bulk materials into open-mouth bags 2. Preferably the open-mouth bags 2 are manufactured in a bag forming station 27 of the apparatus 1. To this end the apparatus 1 comprises a roll accommodation 24 for a tubular film roll 25. The roll accommodation 24 may be mounted to, or placed separately in front of, the apparatus 1.

A variety of deflection rollers 31 shown in simplistic views provide intermediate storage, not illustrated in detail, to enable the tubular film roll 25 to unwind quasi continuously. Alternately it is possible to feed prefabricated open-mouth bags to the apparatus 1.

The apparatus 1 comprises a frame 40 to which the various components of the apparatus 1 are mounted. A bottom seam station 29 is disposed at the bag forming station 27, presently comprising a pair of welding jaws 41 for making a bottom seam in the supplied tubular film 32. After indexing the tubular film 32 one bag length further, the cutting knife 33 (see FIG. 2) cuts the bag off at the head end so as to provide a separate open-mouth bag 2 intended for filling. Grippers 10 (empty-bag grippers) hold the open-mouth bag 2. Meanwhile the bottom seam of the open-mouth bag 2 may be cooled in the cooling station 28 for the bottom seam to show the required stability for the quantity of product intended for filling.

In addition, apparatus 1 shown in FIGS. 1 to 4 comprises a control device 4 in especially for controlling the filling station 5.

The bag forming station 27 is followed by a variety of processing stations, including in particular the pre-opening station 39, the filling station 5 and the top seam welding station 42 with welding jaws 41. The open-mouth bags 2 are transported between each of the stations (5, 27, etc.) by means of a conveying device 20 which ultimately conveys the open-mouth bags 2 linearly or horizontally through the apparatus 1. The conveying device 20 comprises a support frame 21 to which various sets of grippers 10 are mounted. The support frame 21 is held by a pair of swing arms 22 to swing between two pivot positions. The conveying device 20 is driven by means of a pendulum drive 23 in the shape of an electric motor which by means of an eccentric member 19 allows pendulum motions between forwardly pivoted and rearwardly pivoted support frame 21 positions. The filling station 5 comprises a drive 18 for elevating and lowering the supporting structure 8.

Upstream, a separate pendulum unit 44 may be installed where the pre-opening station 39 and feed grippers 11 are attached. The pre-opening station 39 pre-opens the open-mouth bags and by means of a pivoting motion successively appends the pre-opened open-mouth bags to the filling spout 6 from beneath. The open-mouth bags are moved in the horizontal and vertical directions.

In the forwardly pivoted position illustrated in FIG. 1 the shown open-mouth bag 2 can thereafter be appended to the filling spout 6, which is presently configured as a flap spout 26. The feed grippers 11 take over and then open the open-mouth bag previously formed in the bag forming station 27.

Thereafter the open-mouth bag 2 is conveyed further from the bag forming station 27 to the next station. The bag forming station 39 may be followed by another cooling station 28. The head end 30 of the open-mouth bag 2 is (pre-) opened e.g. by suction banks in the pre-opening station 39. The filling station 5 is reached by way of a pendulum motion of the pendulum unit 44 (see FIG. 7) as is illustrated in FIG. 2.

The one or more feed gripper(s) 11 and the pre-opening station 39 may be identical in all the configurations (as in the exemplary embodiment illustrated). In another variant, first feed grippers 11 first take the empty bag to another cooling station 28, and the pre-opening station 39 (another pre-opening station, or with further feed grippers 11) takes over the empty bag by way of the pendulum lift motion, guiding it pre-opened to the transfer position of the filling spout 6.

Figure 2:
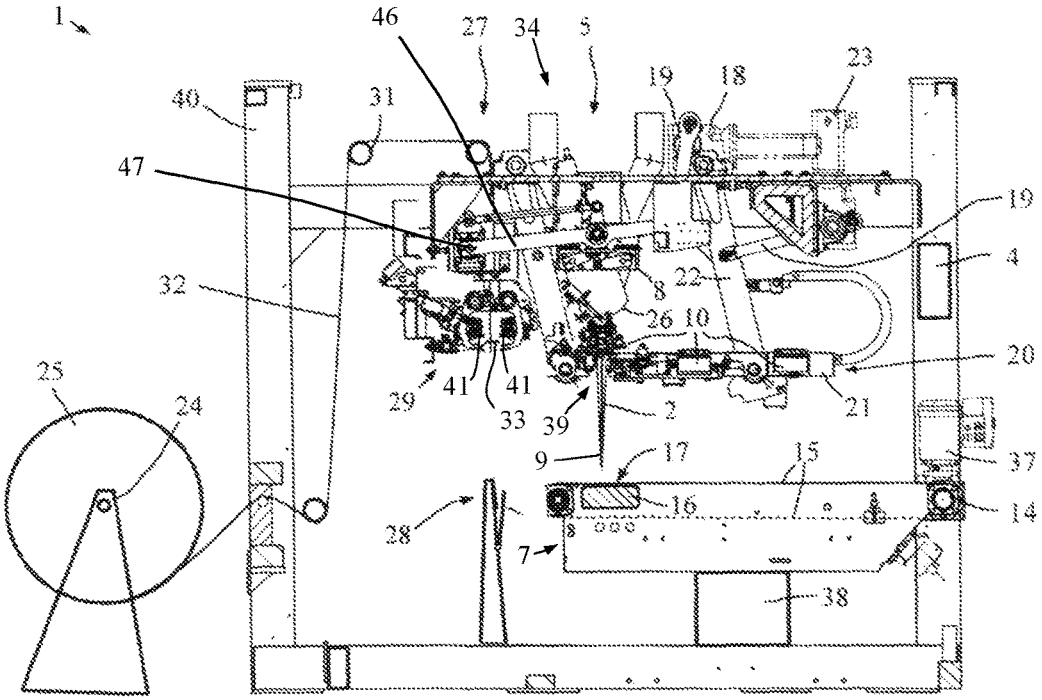
FIG. 2 the apparatus according to FIG. 1 in a second position after appending the open-mouth bag.

In the position illustrated in FIG. 2 the pre-opened open-mouth bag 2 is positioned beneath the filling spout 6. The bottom end of the open-mouth bag 2 is suspended above the support 45 (see FIG. 3) and presently, above the conveyor device 7. In the positions illustrated in the FIGS. 1 and 2, the filling spout 6 is in an elevated position.

The conveyor device 7 is height-adjustably disposed on the frame 40 for compensating and setting different bag lengths by way of height adjustment 38. The conveyor device 7 is not height adjusted for each single filling so as to enable considerable ease of driving and a considerably simple configuration of height adjustment.

Optionally the conveyor device 7 may be separately disposed on the floor. The conveyor device 7 comprises a belt section 15 that is in particular configured as a conveyor belt. The surface of the belt section 15 forms a bearing surface 17 for example for filled open-mouth bags 2.

The belt section 15 is diverted by deflection rollers 14. An electric motor 37 may serve for driving.

The conveyor device 7 extends up to beneath the filling station 5 and up to beneath the filling spout 6, such that a compacting device 16 received or disposed on the conveyor device 7 is likewise positioned beneath the filling spout 6 in the vertical direction.

The compacting device 16 is received on the conveyor device 7 such that the compacting device 16, while it is active, acts on the carrying belt section 15 of the conveyor device 7 and on the bearing surface 17 of the conveyor device 7. This allows processing (after lowering the filling spout) an open-mouth bag 2 resting on the conveyor device 7 respectively an open-mouth bag 2 supported by the conveyor device 7, by means of the compacting device 16. This enables compacting the bulk material in the open-mouth bag 2 already during the filling process.

First, however, the open-mouth bag 2 is appended to the flap spout 26, as FIG. 2 illustrates. In the appending motion, which is, at least relatively, also directed upwardly, the tips of the flap spout already enter the pre-opened head end of the open-mouth bag 2. In the same way the holding grippers 12, not recognizable in FIG. 2, take over the open-mouth bag 2 in the gusseted region of the open-mouth bag, so that on the pendulum unit 44 the grippers 10 can release the open-mouth bag 2 intended for filling. The bottom end 9 of the open-mouth bag 2 intended for filling does not rest on the conveyor device 7. This is significant so that as filling begins the bottom end (always) unfolds properly.

This is achieved because, prior to beginning filling respectively after finishing a preceding filling, the supporting structure 8 with the filling spout 6 and the holding grippers 12 and having an associated, generally laterally-extending lever 46 is transferred relative to a fixed structure 47 to the elevated position 34 illustrated in the FIGS. 1 and 2. In this way the distance from the conveyor device 7 becomes large enough for the bottom end 9 of a subsequently appended open-mouth bag to not make contact with the conveyor device 7. However, there is at least a (small) gap between the bottom end 9 of the open-mouth bag 2 intended for filling and the bearing surface 17 of the conveyor device 7. At least the degree of freedom of the bottom end 9 is large enough so that the bottom can freely unfold with the first product (product thrust) entering.

Figure 3:
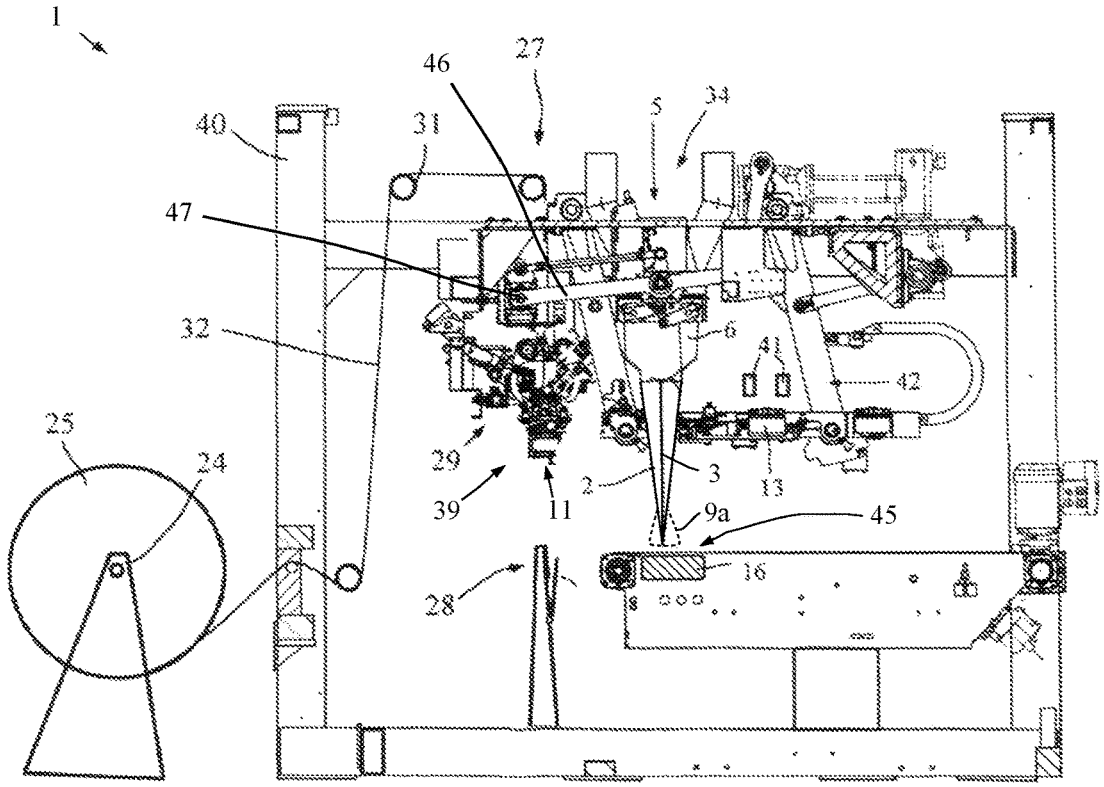
FIG. 3 the apparatus of FIG. 1 in a third position.

In FIG. 3 the flap spout 26 is furthermore tipped up so that the filling process can start. The flap spout together with the supporting structure 8 and the holding grippers 12 is in the elevated position 34. The supporting structure 8 is still in the elevated position 34. The bottom end 9 of the open-mouth bag 2 is freely suspended.

Thereafter the filling process starts, wherein bulk material is introduced into the open-mouth bag 2. The timed coordination is such (in particular based on empirical values) that the product thrust first entering the open-mouth bag 2 unfolds the bottom end 9 of the open-mouth bag 2 (as far as possible wrinkle-free). An unfolded bottom end 9*a* is schematically shown in broken lines in FIG. 3.

Lowering the supporting structure 8 may be initiated thereafter or previously, by coordination, so that the conveyor device 7 in particular supports the bottom end 9 of the open-mouth bag 2 as soon as possible following unfolding the bottom end 9 of the open-mouth bag 2. This allows for the compacting device 16 accommodated there to act on the bottom end 9 of the open-mouth bag 2 and to effectively compact already during filling any bulk material that is already present.

Figure 4:
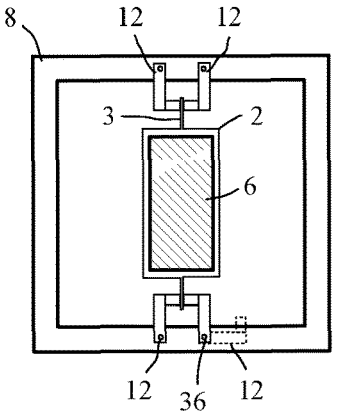
FIG. 4 a simplistic horizontal cross section of the filling station.
Figure 5:
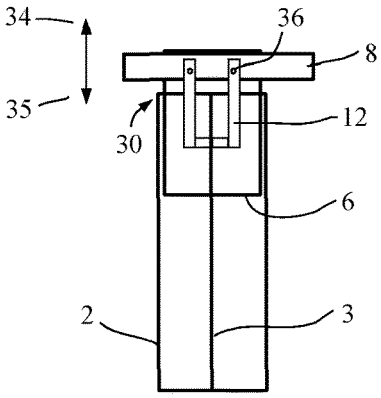
FIG. 5 a side view of another filling station.

FIGS. 4 and 5 show two variants of the arrangement of the holding grippers 12 on the supporting structure 8 of the filling station 5. FIG. 4 shows a horizontal cross section of the filling station with the schematic, cross sectional view of the filling spout 6 to which an open-mouth bag 2 is appended. The supporting structure 8 retains the filling spout and also the holding grippers 12. The holding grippers 12 are shown in the closed state, gripping the gussets 3 of the open-mouth bag 2 for controlled retaining of the open-mouth bag 2 during the filling process. A holding gripper 12 in the opened state is also shown in broken lines. The holding gripper 12 needs to be pivoted outwardly far enough to allow discharging (and feeding) an open-mouth bag intended for filling between the holding grippers 12.

FIG. 5 shows another variant with holding grippers 12 pivotable, not by vertical but by horizontal axes 36. The holding grippers 12 can pivot within the supporting structure 8 and they in turn serve to seize the gusseted regions 3 of the open-mouth bags 2. Again, the open-mouth bag 2 is received on the filling spout 6.

Figure 6:
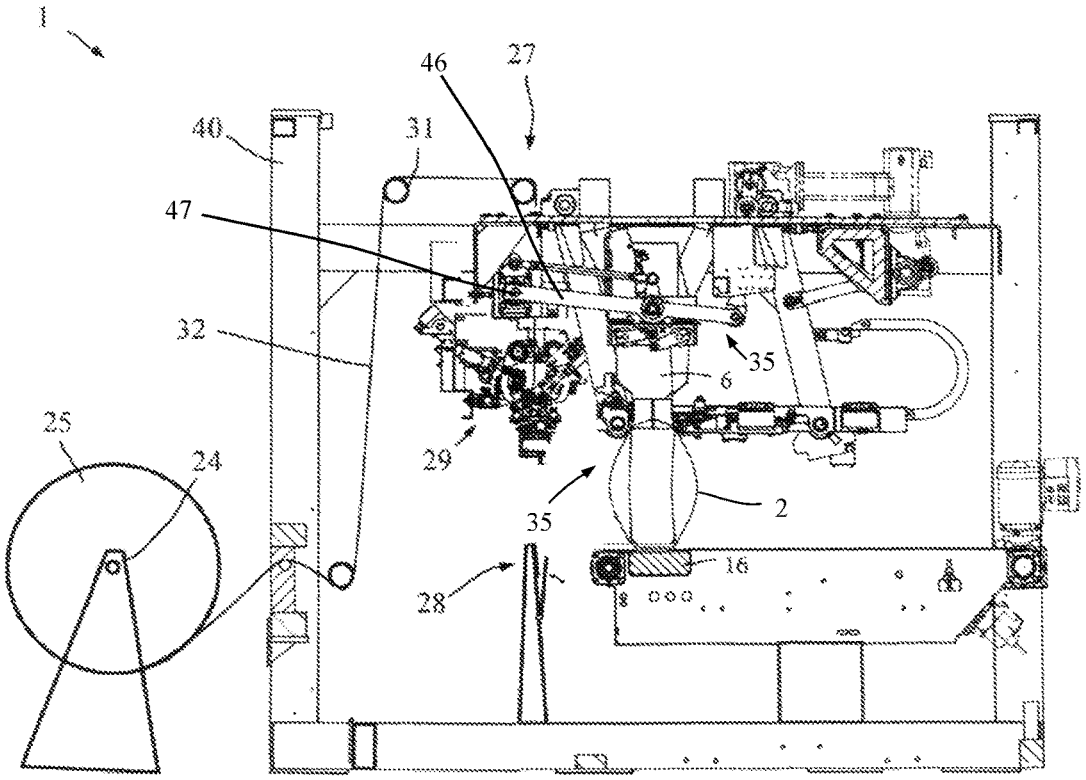
FIG. 6 the apparatus according to FIG. 1 in a fourth position.

FIG. 6 finally shows a schematic side cross section of the apparatus of FIG. 1, with a filled open-mouth bag 2 schematically inserted.

The lowered position 35 of the supporting structure including the filling spout 6 and holding grippers 12 shown in FIG. 6 is taken shortly after beginning filling, so that the bottom end 9 of the open bag 2 intended for filling can already be processed by the compacting device 16 during a considerable portion of the filling process so as to achieve effective compaction of the bulk material intended for bagging.

Upon completion of the filling process, the filled open-mouth bag is closed and discharged by the conveyor device 7. The filling spout 6 respectively the supporting structure including the filling spout 6 is transferred upwardly to the elevated position 34, so that the bottom end 9 of the next open-mouth bag 2 intended for filling is once again freely suspended above the conveyor device 7.

Figure 7:
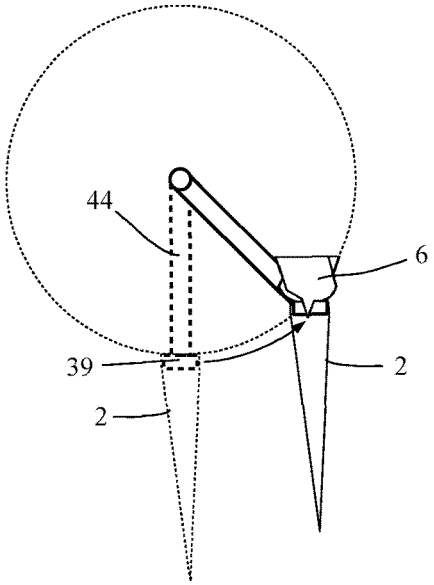
FIG. 7 a schematic view of a pendulum unit with a pre-opening station.

FIG. 7 shows a simplistic side view of the pendulum unit 44 with the pre-opening station 39 attached thereto. In the position shown in broken lines the open-mouth bag 2, also shown in broken lines, is in a downwardly position and has already been pre-opened by the pre-opening station 39. A pivoting or pendulum motion pivots the pre-opened open-mouth bag 2, presently to the right and upwardly, so that the pre-opened open-mouth bag 2 is pulled over the filling spout 6 from beneath. Relatively speaking, the filling spout 6 dips into the pre-opened open-mouth bag 2 from above. The open-mouth bag 2 is then opened completely by tipping the flap spout open.

Since the apparatus shown is a high-performance machine which allows to manufacture and fill up to 2600 open-mouth bags and more per hour, the index time per each index is just slightly longer than 1 second. Thus, only a duration of mostly less than 1 second is available for the filling process proper. This is why an early beginning of effective compaction is considerably advantageous.

On the whole the apparatus according to the invention and the method according to the invention offer considerable advantages since the efficiency of filling bulk materials into open-mouth bags can be increased considerably, involving little complexity and ease of operation, by way of a single and indexed "simple spout lift". The conveyor device may and should be disposed up to beneath the filling spout so that a compacting device disposed there acts on the bottom end of the open-mouth bag already during filling. It is not required to have a drop-down conveyor belt as is provided in the prior art. It is sufficient to elevate the filling spout with the appended open-mouth bag and to start the filling process. During the filling process the open-mouth bag is lowered back down on the conveyor device and the compacting device contained therein. It has even been found that the drive for elevating the filling spout including the holding grippers does not need to be configured more powerful than the drive for elevating the filling spout used thus far, although now the supporting structure 8 does not only hold the filling spout 6 and the empty open-mouth bag 2 during the filling process but also holds a considerable portion of bulk material before the partially filled open-mouth bag 2 is deposited on the conveyor device 7.

Furthermore, no thrust flaps are required for pulling the open-mouth bag 2 off a separate vibrator. This releases the load on the drive for the conveying device somewhat. The drive for the conveyor device 7 does not need to be designed more powerful since a filled bag had to be accelerated previously.

The bulk materials bagged are preferably granular products. It is also possible to bag cement or similar products using the apparatus according to the invention.

Another advantage is that a separate drive for elevating and lowering a compacting device can be dispensed with. The compacting device does not require elevating and lowering in operation.

It is also advantageous that the compacting device can be integrated in the conveyor device or in the bag discharge belt where it may be positioned immediately beneath the carrying belt side. A considerable advantage is that the conveyor device is generally static and there is no drop-down section.

While a particular embodiment of the present device and method for packaging bulk materials in open bags has been described herein, it will be appreciated by those skilled in the art that changes and modifications may be made thereto without departing from the invention in its broader aspects and as set forth in the following claims.

List of reference numerals:

| | |
|---|---|
| 1 | apparatus |
| 2 | open-mouth bag |
| 3 | gusset |
| 4 | control device |
| 5 | filling station |
| 6 | filling spout |
| 7 | conveyor device |
| 8 | supporting structure |
| 9 | bottom end |
| 9a | unfolded bottom |
| 10 | gripper |
| 11 | feed gripper |
| 12 | holding gripper |
| 13 | discharge gripper |
| 14 | deflection roller for 15 |
| 15 | belt section |
| 16 | compacting device |
| 17 | resting surface |
| 18 | drive for 8 |
| 19 | eccentric member |
| 20 | conveying device |
| 21 | support frame |
| 22 | swing arm |
| 23 | pendulum drive |
| 24 | roll accommodation |
| 25 | tubular film roll |
| 26 | flap spout |
| 27 | bag forming station |
| 28 | cooling station |
| 29 | bottom seam station |
| 30 | head end |
| 31 | deflection roller for 32 |
| 17 | tubular sheet |
| 33 | cutting knife |
| 34 | elevated position |
| 35 | lowered position |
| 36 | pivot point of 12 |
| 37 | drive for 7 |
| 38 | height adjustment of 7 |
| 39 | pre-opening station |
| 40 | frame |
| 41 | welding jaw |
| 42 | top seam welding station |
| 44 | pendulum unit |
| 45 | support |

The invention claimed is:

1. A method for filling bulk materials into open-mouth bags comprising the following steps:

a) an open-mouth bag is appended from beneath to a filling spout of a filling station mounted on a frame by way of an at least partially upward motion, so that the bottom end of the appended open-mouth bag is freely suspended, wherein the filling station accommodates the filling spout together with holding grippers in a height-adjustable supporting structure, wherein the height-adjustable supporting structure includes a—generally laterally-extending lever, wherein the supporting structure is configured to move vertically relative to the frame and the supporting structure, the filling spout and the appended open-mouth bag are located on the frame below a drive for vertically moving the supporting structure, wherein the filling spout is mounted on the supporting structure, such that as the supporting structure is moved vertically, the filling spout, the lever and the appended open-mouth bag are moved as a unit between an elevated position and a lowered position, wherein the appended open-mouth bag is unsupported in the elevated position but receives product through the filling spout, and wherein the bag is supported by a conveyor device when the filling spout and the supporting structure are in the lowered position;

b) a filling process is started when the filling spout is in the elevated position and an initial product thrust of bulk material is introduced into the appended open-mouth bag so that the freely suspended bottom end of the appended open-mouth bag unfolds; and c) the filling spout is lowered into the lowered position together with the appended open-mouth bag towards the conveyor device by movement of the supporting structure, so that the unfolded bottom end of the appended open-mouth bag is supported by the conveying device after the bottom end of the bag has been unfolded by the initial product thrust, for completion of the filling of the appended open-mouth bag, wherein step c) is carried out during the filling process, and wherein the bulk material in the open-mouth bag resting on the conveyor device is compacted during the filling process by a compacting device disposed beneath a bearing surface of the conveyor device.

2. The method according to claim 1, wherein the bottom end of the appended open-mouth bag is supported at least during part of the filling process.

3. The method according to claim 1, wherein in the method step a), the holding grippers grasp the open-mouth bag and in the method step c), the holding grippers are lowered together with the filling spout.

4. The method according to claim 1, wherein after filling and method step c) are completed, the holding grippers release the open-mouth bag and travel upwardly together with the filling spout, while the open-mouth bag rests on the conveyor device.

5. The method according to claim 1, wherein, after filling is completed, the open-mouth bag is conveyed further by the conveyor device.

6. The method according to claim 1, wherein during a further transport, the open-mouth bag is guided by a head end of the open mouth bag by discharge grippers.

7. The method according to claim 1, wherein the open-mouth bag is formed from tubular film prior to appending.

8. The method according to claim 7, wherein the tubular film is unwound from a film roll and a bottom seam is first made in the tubular film, and wherein the tubular film is thereafter conveyed further by one index length, and wherein the tubular film is cut off at a head end to form the open-mouth bag.

9. The method according to claim 1, wherein a head end of the open-mouth bag is pre-opened prior to being appended to the filling spout.

10. The method according to claim 1, wherein the filling spout configured as a flap spout and having entered a pre-opened head end of the open-mouth bag, tips open and further opens the head end.

* * * * *